US009109864B2

(12) United States Patent
Beckman

(10) Patent No.: US 9,109,864 B2
(45) Date of Patent: Aug. 18, 2015

(54) MISSILE WITH MID-FLIGHT OXIDIZER CHARGING

(71) Applicant: Christopher V. Beckman, San Diego, CA (US)

(72) Inventor: Christopher V. Beckman, San Diego, CA (US)

( * ) Notice: Subject to any disclaimer, the term of this patent is extended or adjusted under 35 U.S.C. 154(b) by 288 days.

(21) Appl. No.: 13/666,965

(22) Filed: Nov. 2, 2012

(65) Prior Publication Data

US 2014/0311371 A1 Oct. 23, 2014

(51) Int. Cl.
*F42B 15/01* (2006.01)
*F42B 12/52* (2006.01)

(52) U.S. Cl.
CPC ..... *F42B 15/01* (2013.01); *F42B 12/52* (2013.01)

(58) Field of Classification Search
CPC ..... F42B 15/01; F42B 12/52; F42B 12/46; F42B 10/60; F42B 15/00; F42B 12/02; F42B 10/00; F42B 12/36
USPC ..... 102/481, 501; 244/3.22
See application file for complete search history.

(56) References Cited

U.S. PATENT DOCUMENTS

| | | | | |
|---|---|---|---|---|
| 2,987,875 | A * | 6/1961 | Fox | 60/245 |
| 3,011,307 | A * | 12/1961 | Edelfelt | 137/15.1 |
| 4,096,803 | A * | 6/1978 | Kesting | 102/378 |
| 4,372,505 | A * | 2/1983 | Syberg | 244/53 B |
| 4,428,293 | A * | 1/1984 | Botwin et al. | 102/381 |
| 5,167,249 | A | 12/1992 | Karanian | |
| 5,303,653 | A | 4/1994 | Sullivan | |
| 5,513,571 | A * | 5/1996 | Grantz et al. | 102/374 |
| 6,058,846 | A * | 5/2000 | Boyd | 102/374 |
| 6,647,888 | B1 * | 11/2003 | Cesaroni et al. | 102/289 |
| 7,051,659 | B2 * | 5/2006 | Tyll et al. | 102/374 |
| 7,721,989 | B2 | 5/2010 | Dyer | |
| 8,210,474 | B2 | 7/2012 | Dyer | |
| 8,312,813 | B2 * | 11/2012 | McDermott et al. | 102/490 |
| 8,398,016 | B2 * | 3/2013 | Porte et al. | 244/53 B |
| 2009/0114774 | A1 | 5/2009 | Dyer | |
| 2010/0025542 | A1 | 2/2010 | Dyer | |

* cited by examiner

*Primary Examiner* — Joshua Freeman

(57) ABSTRACT

New missile systems are provided, implementing reduced pre-deployment weight, higher impact and greater deployment flexibility, among other advantages. In some embodiments, mid-flight oxygen filtration from atmospheric air, followed by concentration, compression and/or storage in ideal oxidizer deployment locations, leads to enriched, greatly increased oxidizer load and/or far greater missile weight just prior to impact. Among additional benefits, missiles implementing the system may be far less volatile, and therefore safer, prior to deployment and the concentration of oxidizer may be more concentrated than with ambient oxygen, overcoming the limitations of current fuel/air and other thermobaric explosives.

20 Claims, 6 Drawing Sheets

Flg. 2

MISSILE WITH MID-FLIGHT OXIDIZER CHARGING

FIELD OF THE INVENTION

The present invention relates to the fields of exothermic weapons and aeronautics. More specifically, the invention relates to missiles, bombs and deployment systems.

BACKGROUND

In modern warfare, missiles and bombs often implement explosive payloads detonated upon impact at a target, or at a related time and/or place. These payloads often involve combustion, and, therefore, the use of an oxidizer.

Certain missile and bomb systems, such as "fuel-air" and other thermobaric systems, spread explosive material into the atmosphere surrounding or within a target, to strengthen and/or extend an explosive impact. Typically, these systems use primary and secondary charges, where the primary charge serves to inject and/or spread explosive material into ambient air at the target, after which the secondary charge ignites the resulting mixture. Thermobaric bombs may amplify and extend the impact of an explosive payload generally, and may aid in overcoming obstacles, such as bunkers or other enemy cover.

Some missiles, such as ramjet missiles, involve air intake to aid in powering flight. Such missiles may operate at high speeds, including supersonic speeds, and may implement variable-inlet chins. See, e.g., U.S. Pat. No. 5,167,249. In these applications, the size of an air inlets may be varied to optimize air shock, efficiency and flight power.

SUMMARY OF THE INVENTION

New missile systems are provided, implementing reduced pre-deployment weight, higher impact and greater deployment flexibility, among other advantages. In some embodiments, mid-flight oxygen filtration from atmospheric air, followed by concentration, compression and/or storage in ideal oxidizer deployment locations, leads to enriched, greatly increased oxidizer load and/or greatly increased missile weight just prior to impact. Among many other benefits, missiles implementing aspects of the invention:

1.) Are far less volatile, and therefore safer, prior to deployment;

2.) May be flexibly-deployed as a (a) conventional explosive warhead, (b) a thermobaric warhead, (c) a mixture of the two, (d) an increased-weight kinetic weapon or (c) one of several yield sizes, coverages or burn rates, among other options, and such deployment options may be selected in-flight, for example, by tactical command;

3.) May be far lighter during transportation and platform maneuvers than conventional missiles with comparable warhead fuel; and 4.) The concentration of oxidizer may be more concentrated than with ambient oxygen, overcoming those limitations of current fuel/air and other thermobaric explosives.

These and other advantages of the present invention may be better understood by reviewing the more detailed aspect disclosures set forth below. It should be noted that the particular embodiments and terms set forth below are exemplary only, and that the scope of the invention includes any of virtually limitless other alternatives that may be substituted to carry out any aspect set forth below. As a rule of construction: where this application recites a number, gender or other specific qualifiers in the form of articles and pronouns, it should be understood that, where logically possible, any other number, gender or qualifier should also be separately read in as another alternative meaning or expression of the application.

DETAILED DESCRIPTION OF THE INVENTION

Figure 1:
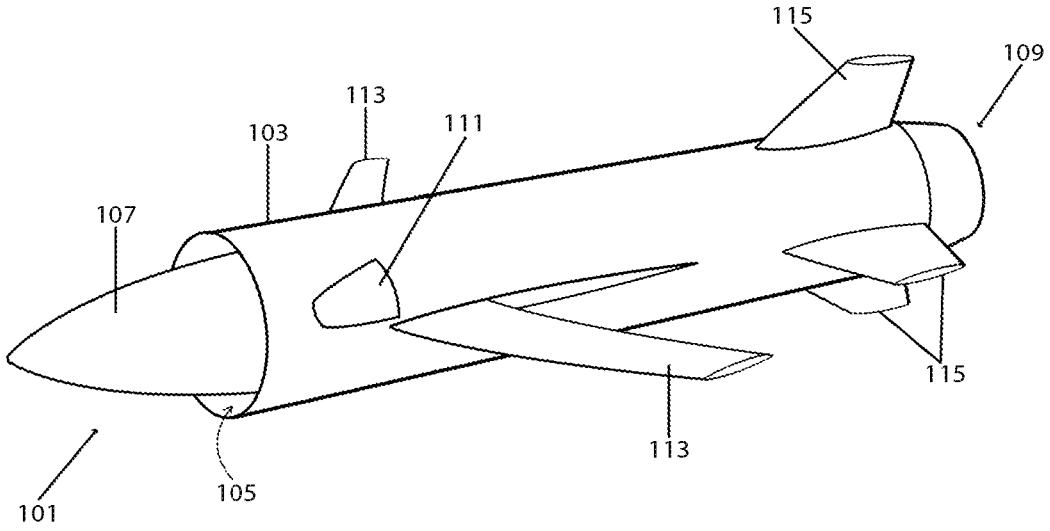
FIG. 1 is a perspective view of outer surfaces of an exemplary missile system that may be used to carry out aspects of the present invention.

FIG. 1 is a perspective view of outer surfaces of an exemplary missile system 101, which may be used to carry out aspects of the present invention. System 101 includes a missile housing 103, preferably with variable geometry and variable airflow aspects. For example, a variable-size air inlet 105 is partially variably-defined by an actuable nose piece 107. If selected by a user and/or control system, such as the system set forth in FIG. 5, nose piece 107 may retract inward and toward the tail end and thruster 109 of the missile, and thereby increase the size of the gap of the air inlet 105. When open, and in flight, the air inlet 105 may allow ambient air to flow inside the housing 103 and, as will be discussed in greater detail below, into various additional interior aspects for processing and storage functions. Such interior aspects may include intake(s) for jet propulsion (though they also may not, for example, if solid fuel rocket power is used) and power conversion but will, preferably at the user and/or system's election, include intakes for gas filtration and/or compression and/or storage. An airflow outlet may also be required to communicate with and/or service such interior aspects, and an exemplary pressure-reducing outlet panel louver 111 is pictured, which may draft for and reduce the outside air pressure onto, such an outlet—in part, to aid filtration aspects, as will be discussed in greater detail below. In addition, by varying airflow through such outlets at locations beneath and above wing and other aeronautically significant elements, and depending on the outlet airflow angles chosen (which may be variable by the system and/or user) the missile system may also aid in controlling lift, yaw, pitch, roll and other flight dynamics, as a side-benefit.

In addition to the variable-intake geometry discussed above, which may be variably actuated by, for example, servo motors controlled by the control system, the missile may include any conventional or known missile aspects, such as variable geometry wings 113, radial guidance and stabilization fins 115, and any other known missile embodiments and alternatives in the art. As explained elsewhere in this application, the exact designs depicted in this and other figures are exemplary only.

Figure 2:
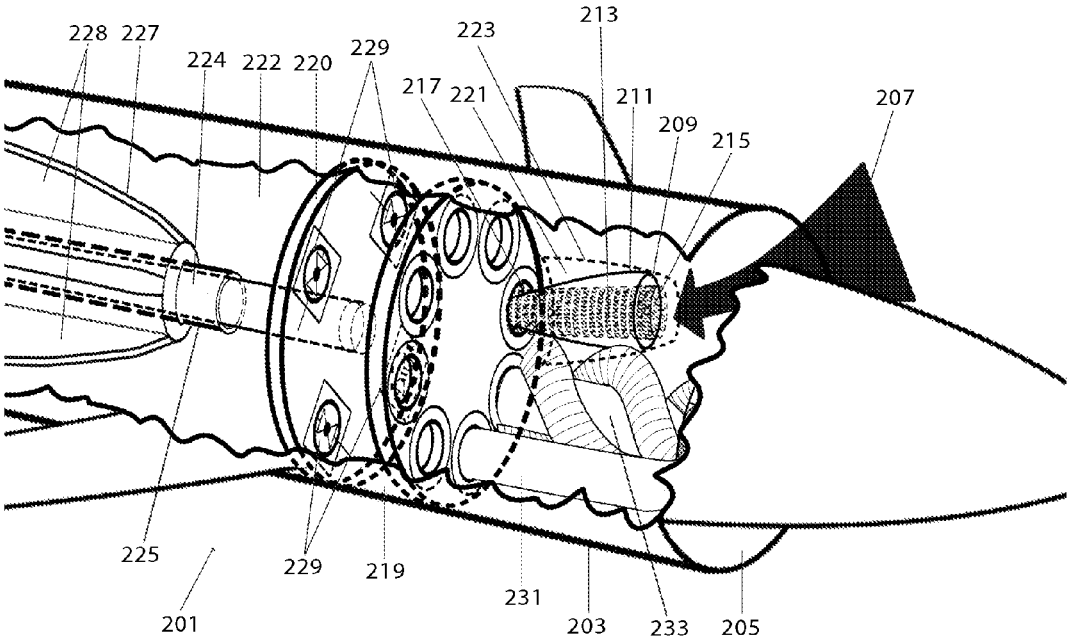
FIG. 2 is a partial view, in perspective and partly in section and schematic, showing some interior aspects an exemplary missile system that may be used to carry out aspects of the present invention.

FIG. 2 is a partial view, in perspective and partly in section and schematic, showing some interior aspects an exemplary missile system 201 that may be used to carry out aspects of the present invention. A missile housing 203 with a variable-size air inlet 205 leads in-flowing ambient air from the front of the missile due to flight (as shown by airflow representing arrow 207) to an inlet port 209 for an interior filter 211. Interior air filter 211 includes at least a portion of a filtration medium or element 213, for example a zeolite cylindrical matrix that preferentially absorbs nitrogen, as pictured, suitable for selectively absorbing and/or filtering ambient gases from the airflow 207 that then flows against and through it. Preferably, filtration element 213 may rotate or be actuated to rotate on an axis 215, such that a variable part of it may be exposed to airflow 207. As air flows over the exposed portion of element 213, nitrogen and other gases may be absorbed, and filtered out of the airflow, while oxygen-enriched air continues to flow toward the tail end of the filter 211, through a port 217 to an interior enriched gas intermediate storage chamber 219. Preferably, port 217 includes a one-way valve, permitting compresses and enriched airflow 207 (after it passes through filter element 213) into intermediate chamber 219, but not back into filter 211 from intermediate chamber 219.

Inlet 205 preferably comprises a relatively broad leading surface area engaging airflow 207 upon entry, and serves to funnel that airflow to a narrower surface area at the point of entry at the inlet port 209 of filter 211. As a result, upon entering filter 211, airflow 207 becomes more highly pressurized than it was prior to entering the missile housing 203. As filtration element 213 experiences pressurized airflow and selectively absorbs non-oxidizing gasses (including, but not limited to, nitrogen) in its portion exposed to that airflow, it may automatically, or by actuation by the system, rotate and thereby move a more saturated portion away from airflow 207, until that more saturated portion no longer is exposed to airflow 207 and instead faces and is housed within a pressure-reducing waste gas outlet volume 221, defined by a pressure-reducing exterior louver 223 (which may be similar to the louver 111 pictured from an exterior viewing angle in FIG. 1). Because the volume then housing the saturated portion of the filter element has greatly reduced gas pressure, gasses saturating that section, including nitrogen, then escape the filter element 213, rendering it desaturated again and ready for return to the pressurized (left-hand) section of the filter with the capacity to absorb more of such gasses from airflow 207. By virtue of the same rotation, a more desaturated portion of element 213 therefore becomes exposed to airflow 207, and more effectively selectively filters gases from it, further enriching airflow 207 with oxygen, which is selectively less absorbed. This rotation can be gradual, continuous or by degrees, even if driven or partially driven by the airflow itself—for example, due to spin-inducing surfaces on element 213 or an attached object—to optimize the effectiveness and efficiency of the filter. For example, sensors may indicate the concentration of oxygen and other atmospheric gases in the airflow upon exiting the filter in comparison to the concentration upon entrance to enable a control system to determine that effectiveness and efficiency, and, thereby, whether to rotate filter element 213. Alternatively, sensors may drive circulation or rotation of filtration element(s) in reaction to their saturation with filtered gases or in reaction to the concentration of waste gasses in volume 221. While this method of filtration and oxygen enrichment of airflow is preferred, it should be noted that any known method for filtering, concentrating and retaining oxidizing gasses, such as oxygen, from a gas mixture, such as atmospheric air, may, alternatively, be used and are within the scope of the invention. Some aspects of the invention (not pictured) may include auxiliary pressurizing devices for increasing the efficiency of filtration, as well as multiple filter tiers for removing additional non-oxidizing gasses.

After the airflow process described above, intermediate storage chamber 219 then contains oxygen-enriched air, which may be compressed by piston-compressor wall 220, and selectively passed to warhead/end storage unit volume 222. Compressor wall 220 may be driven by a piston-driving rod 224 within a rod guide 225. Rod guide 225 may also serve as a platform for shaped fuel and/or explosive charges and/or sections, such as that shown as 227, which include concavities 228 that encourage the mixture and dispersion of fuel with the concentrated oxidizing agents in unit 222 upon deployment of the warhead (which may be thought of as, at least, including unit 222) by detonator(s) (not pictured). Any known techniques for explosive ordinance and warhead deployment and detonation may be used in conjunction with the aspects of the invention herein discussed, and such techniques should be understood to be included in the scope of the invention as if set forth in detail here.

Control valves, such as those pictured as 229, which may be controlled by the control system or locally controlled by pressure, concentration, volatility and/or other sensors, may permit compressed and enriched oxidizing gas to pass from intermediate chamber 219 into warhead/end storage unit volume 222 when sufficient (and/or not too great) compression, oxygen enrichment and other factors indicating desirable gas conditions for storage are sensed. Such sensors may be on or about wall 220 and/or intermediate chamber 219 and warhead/end storage unit volume 222, and the standards for assessing adequate conditions may be altered according to mission parameters, desired detonation strength or detonation nature (or lack thereof, if a purely kinetic weapon is selected) and such parameters may be variably set, even mid-mission, by the control system—which may be in communication with and include distant, real-time tactical command elements. Assuming that a large-yield oxidizing agent-enriched detonation(s) is/are required at or about a target, however, and further assuming that the concentration of enriched oxygen within intermediate chamber 219 is determined to be insufficient by the control system, the control system may not yet actuate compression and transfer to warhead/end storage unit 222 by compression wall 221 and its control valves 229. Instead, the system may drive or permit further enrichment of the same gas by the same or (as pictured) additional filtration elements. Those additional filtration elements may include a circulation pump and recirculation channeling, which may be external to intermediate chamber 219 to enable full use of 219's volume by compression elements, such as wall 220. More specifically, a recirculation outlet tube 231 may conduct gas from intermediate chamber 219 into the front of a turbine-driven filtration element 233, which may further enrich the gas and pass it once again to intermediate chamber 219. Such a refiltration circuit comprising 231 and 233 may be selectively driven by the control system in such amounts and for such time as may be required for the mission. These refiltration elements will be discussed in greater detail in reference to FIG. 3.

As discussed elsewhere in this application, various warhead mode selections may be made by a Command and Control for execution by the system, including modes that change the deployment, concentration and compression of fuel and oxidizer. In addition, the timing of detonation aspects may be dictated by such modes, including dictating primary (scattering) and secondary or tertiary (post obstacle ignition) charges for maximizing impact within closed or guarded targets, such as bunkers. In addition to other such modes, pressure sensors may be used (which may include some sensors discussed above, that survive an initial housing breach or are otherwise exposed to a penetrated target environment) that sense the pressure differential upon penetrating a more confined space from a more open atmosphere, and trigger detonation after such time to penetrate protective walls and other obstacles prior to deployment of ordinance. A split-function deployment may also be used, for example, in which gun firing elements to clear outer-bunker regions, or sound or electromagnetic-disruption elements targeting enemy personnel and materiel, to prevent reaction to the missile, may also be directed in a mode and implemented, if available within the missile system. Any other known warhead or missile ordinance deployment methods or modes may also, or alternatively, be used.

Figure 3:
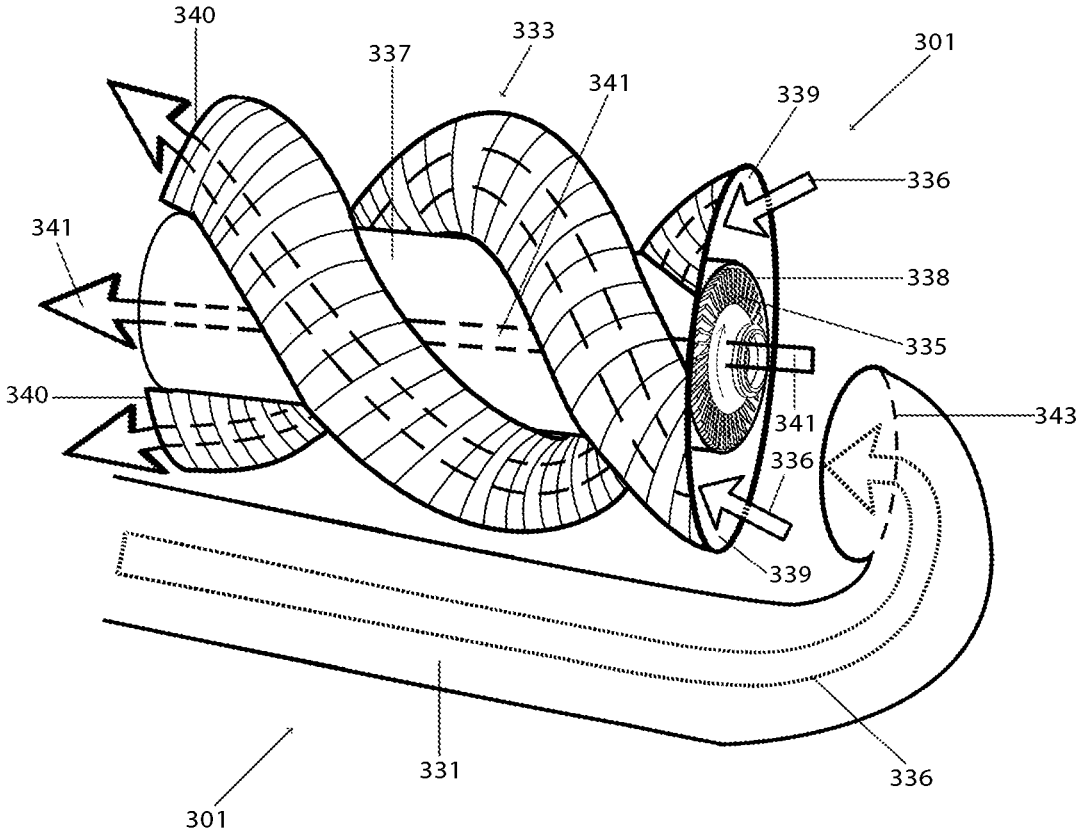
FIG. 3 is a larger, more detailed perspective view of exemplary oxidizer concentration elements discussed previously in FIG. 2.

FIG. 3 is a larger, more detailed perspective view of the exemplary oxidizing agent concentration elements 301, discussed immediately above, in reference to FIG. 2. More specifically, a recirculation tube 331 (previously, 231) and a turbine-driven filtration element 333 (previously 233) are shown separated from one another and the remainder of the exemplary system set forth in FIG. 2. Filtration element 333 includes a central turbo/turbine 335 that may drive recirculation airflow (shown by airflow indicating arrow 336) into a central tube 337, which also at least partially contains the airflow-driving and driven turbine 335. To maximize efficiency, turbine 335 may be driven, at least in part, by an external airflow (depicted by airflow-indicating arrows 336) entering turbocharging tube inlets 339, and exiting both element 333 and the entire missile system through its side housing via outlets 340. Preferably, the turbine 335 is at least partially driven by that external airflow, but that external airflow does not mix with the internal gas airflow, shown by airflow arrow 341 (which is oxidizing agent-enriched) due to gas separation walls between the turbine and turbocharging airflow drivers (not pictured). Although shown separated to reveal detail, in operation, end 343 of tube 331 connects with and forms a complementary, airtight seal with port 338 of central tube 337 and, at its other end, is in communication with a gas storage chamber (for example, intermediate chamber 219 of FIG. 2).

Figure 4:
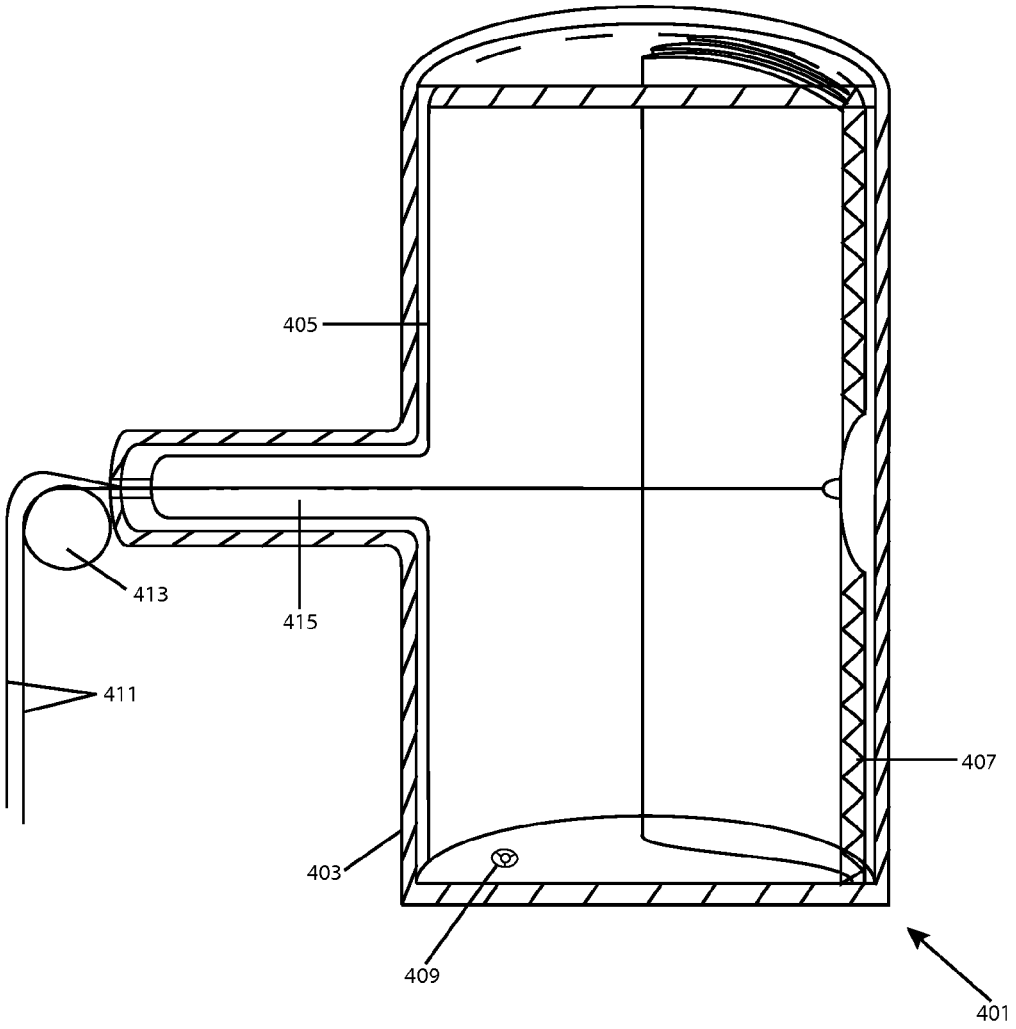
FIG. 4 depicts some alternative exemplary gas compression aspects, using structural potential energy, that may be used in conjunction with aspects of the present invention.

FIG. 4 is a cross-section view depicting alternative exemplary compression aspects 401, implementing structural potential energy, that may be used in conjunction with aspects of the present invention. In FIGS. 2 and 3, an exemplary reciprocating piston-type compression system was described to carry out certain aspects of the invention. It should be understood that a wide variety of other techniques for gas compression, some of which are known in the art, may also be used, alternatively or in conjunction with piston compression. For example, axial flow or centrifugal compression techniques may be used. FIG. 4 depicts a new form of compressor driven by mechanically-stored energy, to minimize weight costs, that may be more great in other energy storage and/or translation techniques used to drive or assist gas compression.

In general, the compression aspects shown in FIG. 4 may use a series of tensioned dynamic storage volume walls to both define and compress a series of variable compression sub-chambers. Prior to deployment, at least one outer layer 403 may, at least in part, define a compressed gas storage volume (which may be part of a warhead, as with unit/volume 222 from FIG. 2, and mounted within a larger missile or bomb structure and system). Unlike other, tensioned layers, which will be described below, outer layer 403 maintains a substantially fixed shape and is not tensioned or bistable, except that it may be to the degree necessary to maintain a pre-deployment vacuum. That shape is approximately cylindrical, and shown in central section along its vertical axis. However, a series of variably-positioned inner compartment-defining walls, such as those partially shown as 405 and 407, are variably tensioned and bistable. In their initial, pre-deployment configuration, any such layers may be in a structural position and configuration shown approximately by 407. Specifically, the walls 407 of a chamber are compacted to the right-hand-side of the storage volume (from the perspective of the viewer of the figure). In this compacted state, several of the vertical sections or members comprised in wall 407 are force loaded against the strength of the outer layer 403 or other structures, and have a high potential energy compared to an uncompacted state, approximately shown by the configuration of wall 405. Such an uncompacted state is the second bistable configuration of inner chamber defining walls, such as 405 and 407, and, thus, transition from the state shown as 407 to that shown as 405 involves a great release of structurally stored energy, which is used to compress gas within such inner chambers. A variable valve (or valves) such as that pictured as 409 permit the mid-missile-deployment-flight filling of the volume defined by outer layer 403, and/or sub-volumes defined by inner chamber walls such as 405 and 407. As such filling takes place (which may be aided by an initial vacuum in the volume defined by these walls), valve(s) 409 may close, or simply be one-way valves prohibiting gas emission from the chamber and sub-chambers, and trigger transition of inner layers (one-per complete volumetric filling) from the high energy bistable state (shown by 407) to the low-energy bistable state (shown by 405). In so transitioning, an inner-chamber defining layer (such as 405 or 407) greatly compresses gasses held in the volume and within those layers, creating a sub-chamber that is a fraction of the overall storage volume. These transitions and compressions may be accomplished or aided by internal air compression gates or valves, on inner chamber walls, such as 405 and 407. Such valves or gates, or valve(s) 409 then may seal such compressed inner layers and the outer layer, but 409 may reopen to permit gasses to fill the next inner layer, such as 407, then next available for filling, bistable transition, and further compression of the next filled remaining volume held within a bistable, sealable subchamber (preferably, sealed just prior to filling and bistable transition). Further structural energy loading may be included, for example, with a series of tensioned cables such as those partially depicted by 411 and/or external reel 413, to assist layers such as 405 and 407 in transitioning from one to the other bistable state, and for assisting in compression of confined air within each sub-chamber at the appropriate time(s) (as may be automatically triggered by partial transition, pressure changes and/or sensors, sensor/motors and a control system, such as, but not limited to, the control system discussed in reference to FIG. 5). If a great excess of wall length results, which cannot be fully held within the outer volume defined by 403, from transition to an uncompacted state, a relief section within outer layer 403, such as 415, for holding excess length of wall or other tensioning members, may also be used.

Figure 5:
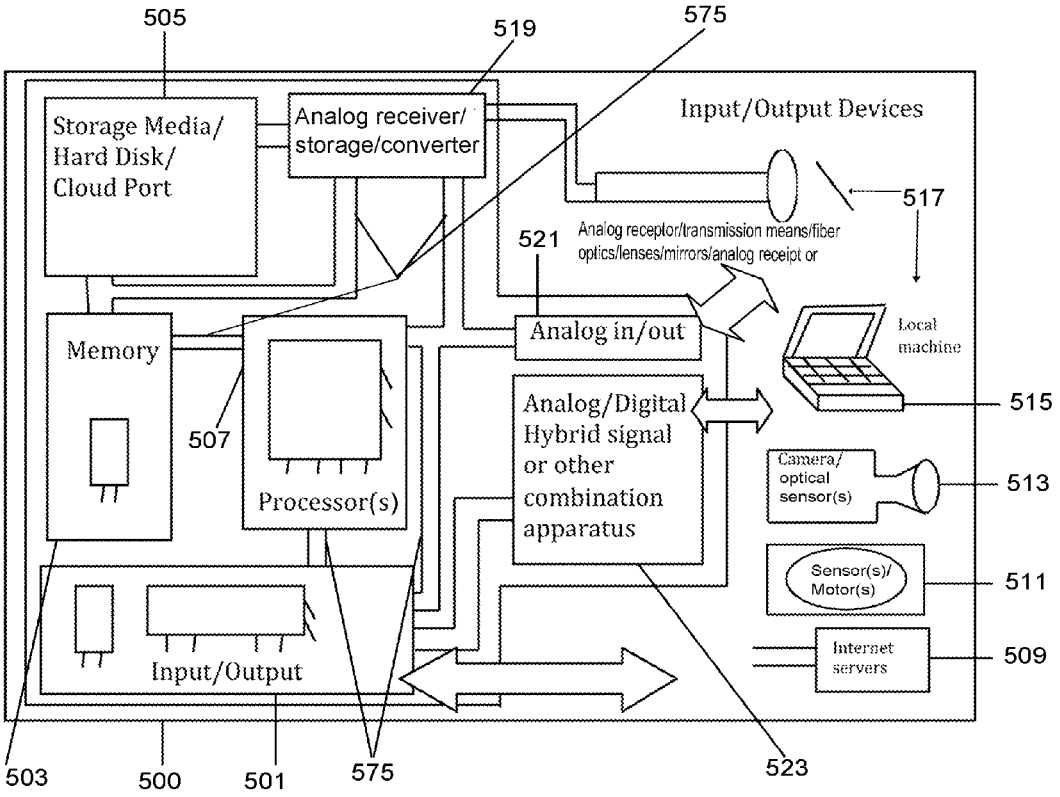
FIG. 5 is a schematic block diagram of some elements of an exemplary control system that may be used in accordance with aspects of the present invention.

FIG. 5 is a schematic block diagram of some elements of an exemplary system 500 that may be used in accordance with aspects of the present invention, such as, but not limited to, sensing gas and physical member compression and gas concentrations and actuating servo/motors and control valves, and receiving control commands and managing input interfaces from a Control and Command, as defined and discussed elsewhere in this application. The generic and other components and aspects described herein are not exhaustive of the many different systems and variations, including a number of possible hardware aspects and machine-readable media that might be used, in accordance with the present invention. Rather, the system 500 is described to make clear how aspects may be implemented. Among other components, the system 500 includes an input/output device 501, a memory device 503, storage media and/or hard disk recorder and/or cloud storage port or connection device 505, and a processor or processors 507. The processor(s) 507 is (are) capable of receiving, interpreting, processing and manipulating signals and executing instructions for further processing and for output, pre-output or storage in and outside of the system. The processor(s) 507 may be general or multipurpose, single- or multi-threaded, and may have a single core or several processor cores, including microprocessors. Among other things, the processor(s) 507 is/are capable of processing signals and instructions for the input/output device 501, analog receiver/storage/converter device 519, and/or analog in/out device 521, to cause a display, light-affecting apparatus and/or other user interface with active physical controls to be provided for use by a user on hardware, such as a personal computer monitor (including, but not limited to, monitors or touch-actuable displays) or terminal monitor with a mouse and keyboard or other input hardware and presentation and input software (as in a GUI), and/or other physical controls.

For example, and with particular emphasis on the aspects discussed below, in connection with FIG. 6, the system may carry out any aspects of the present invention as necessary with associated hardware and using specialized software, including, but not limited to, window presentation user interface aspects that may present a user with a representation of a missile target(s) and present command and control options to, for example, select and move missile control commands (e.g., mouse with cursor or keyboard arrows or joystick or, for example, with dropdown menus, select among various warhead deployment orders) with different settings for each such command. As another example, with reference to FIGS. 1-4, such software may, with or without the presentation of options to a user for selection on a conventional display, carry out any control aspect of the invention as necessary, such as, but not limited to, sensing and implementing compression pressures and gas concentrations, controlling control valves depending on sensor measurements and timing, targeting, warhead conditioning and deployment, identifying a reference point for an observation point, determining a range of possible or likely observation points, and implementing other user interface and processing aspects that may be used in the art, such as physics engines, physical modeling, detection, image-creation and remote control (and related software).

The processor 507 is capable of processing instructions stored in memory devices 505 and/or 503 (or ROM or RAM), and may communicate via system buses 575. Input/output device 501 is capable of input/output operations for the system, and may include any number of input and/or output hardware, such as a computer mouse, keyboard, networked or connected second computer, camera(s) or scanner(s), sensor(s), sensor/motor(s), range-finders, GPS systems, other Command and Control centers, electromagnetic actuator(s), mixing board, reel-to-reel tape recorder, external hard disk recorder, additional hardware controls and actuators, directional shading matrices, directionally-actuable light sources with variable collimation and shiftable bases, additional movie and/or sound editing system or gear, speakers, external filter, amp, preamp, equalizer, computer display screen or touch screen. It is to be understood that the input and output of the system may be in any useable form, including, but not limited to, signals, data, and commands/instructions. Such a display device or unit and other input/output devices could implement a user interface created by machine-readable means, such as software, permitting the user to carry out the user settings, commands and input discussed in this application.

501, 503, 505, 507, 519, 521 and 523 are connected and able to communicate communications, transmissions and instructions via system busses 575. Storage media and/or hard disk recorder and/or cloud storage port or connection device 505 is capable of providing mass storage for the system, and may be a computer-readable medium, may be a connected mass storage device (e.g., flash drive or other drive connected to a U.S.B. port or Wi-Fi) may use back-end (with or without middle-ware) or cloud storage over a network (e.g., the internet) as either a memory backup for an internal mass storage device or as a primary memory storage means, or may simply be an internal mass storage device, such as a computer hard drive or optical drive.

Generally speaking, the system may be implemented as a client/server arrangement, where features of the invention are performed on a remote server, networked to the client and made a client and server by software on both the client computer and server computer. Input and output devices may deliver their input and receive output by any known means of communicating and/or transmitting communications, signals, commands and/or data input/output, including, but not limited to, the examples shown as 517, such as 509, 511, 513 and 515 and any other devices, hardware or other input/output generating and receiving aspects. Any phenomenon that may be sensed may be managed, manipulated and distributed and may be taken or converted as input or output through any sensor or carrier known in the art. In addition, directly carried elements (for example a light stream taken by fiber optics from a view of a scene) may be directly managed, manipulated and distributed in whole or in part to enhance output, and whole ambient light information for an environmental region may be taken by a series of sensors dedicated to angles of detection, or an omnidirectional sensor or series of sensors which record direction as well as the presence of photons recorded, and may exclude the need for lenses or point sensors (or ignore or re-purpose sensors "out of focal plane" for detecting bokeh information or enhancing resolution as focal lengths and apertures are selected), only later to be analyzed and rendered into focal planes or fields of a user's choice through the system. While this example is illustrative, it is understood that any form of electromagnetism, compression wave or other sensory phenomenon may include such sensory directional and 3D locational information, which may also be made possible by multiple locations of sensing, preferably, in a similar, if not identical, time frame. The system may condition, select all or part of, alter and/or generate composites from all or part of such direct or analog image transmissions, and may combine them with other forms of image data, such as digital image files, if such direct or data encoded sources are used.

While the illustrated system example 500 may be helpful to understand the implementation of aspects of the invention, it is understood that any form of computer system may be used to implement many aspects of the invention—for example, a simpler computer system containing just a processor (datapath and control) for executing instructions from a memory or transmission source. The aspects or features set forth may be implemented with, and in any combination of, digital electronic circuitry, hardware, software, firmware, or in analog or direct (such as light-based or analog electronic or magnetic or direct transmission, without translation and the attendant degradation, of the image medium) circuitry or associational storage and transmission, any of which may be aided with external detail or aspect enhancing media from external hardware and software, optionally, by networked connection, such as by LAN, WAN or the many connections forming the internet. The system can be embodied in a tangibly-stored computer program, as by a machine-readable medium and propagated signal, for execution by a programmable processor. The method steps of the embodiments of the present invention may be performed by such a programmable processor, executing a program of instructions, operating on input and output, and generating output. A computer program includes instructions for a computer to carry out a particular activity to bring about a particular result, and may be written in any programming language, including compiled and uncompiled, interpreted languages, assembly languages and machine language, and can be deployed in any form, including a complete program, module, component, subroutine, or other suitable routine for a computer program.

Figure 6:
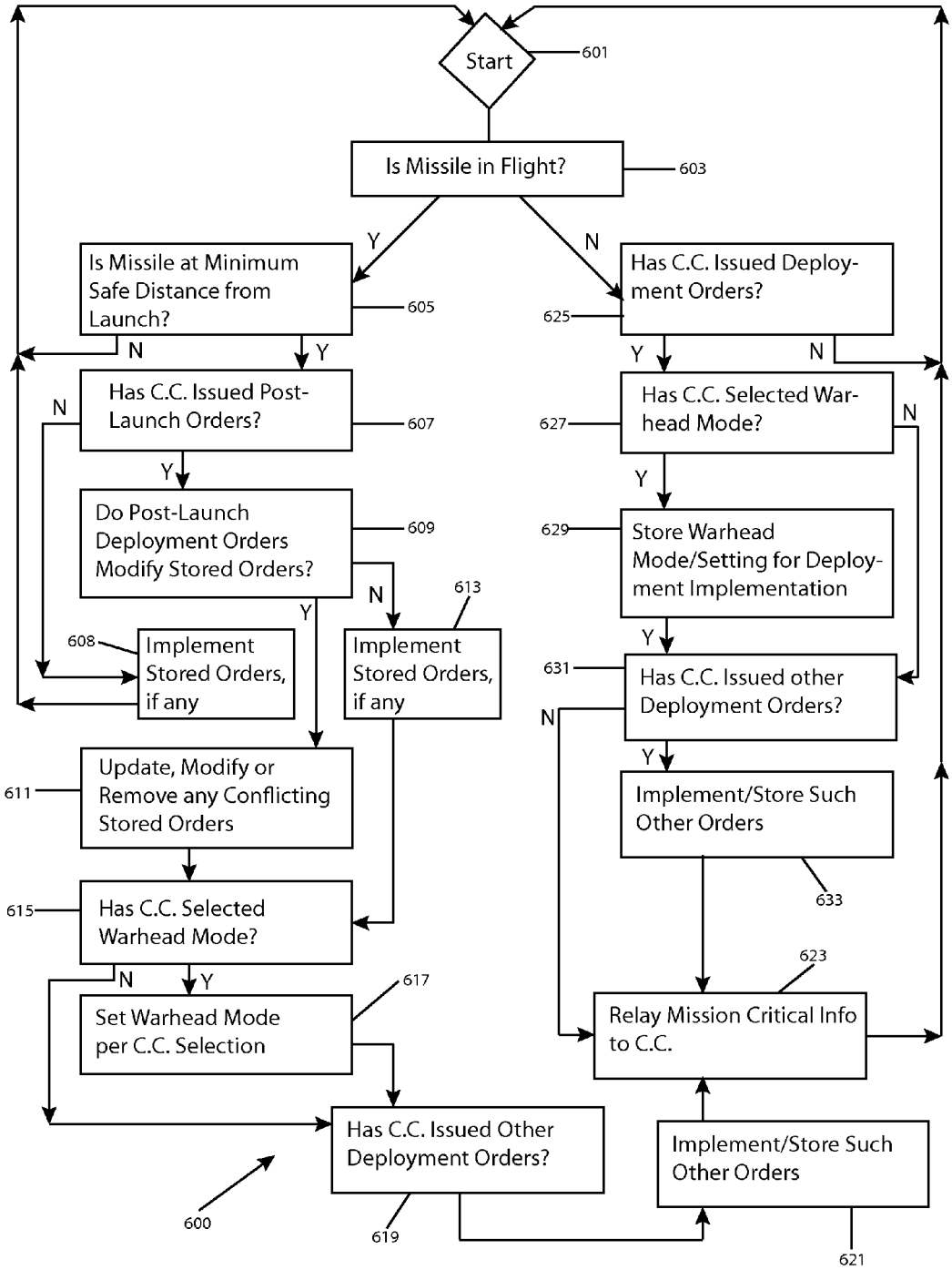
FIG. 6 is a process flow diagram of exemplary steps that may be taken by a system, such as a hardware and software system, implementing aspects of the present invention.

FIG. 6 is a process flow diagram of exemplary steps 600 that may be taken by a system, for example, a hardware and software control system, such as the system discussed above with reference to FIG. 5, implementing certain user interface and missile control aspects of the present invention. Although the process described with reference to FIG. 6 is preferred, and serves to illustrate aspects of the invention, it should be understood that a wide variety of alternative processes may implement aspects of the present invention, and are within its scope. In step 601, the process begins and proceeds to step 603, in which the system determines if an outbound missile subject to control by the system is in flight. Although not shown in FIG. 6, it should be understood that such determinations ordinarily will be made by a remote, secure communication system and transmitted between an on-board missile receiving system and a remote command and control center ("Command and Control" or "C.C.") which originates and implements commands, orders, instructions, selections and decisions from a user and/or systematic decisionmaker(s). If such a missile subject to the system's control is detected to be in flight, for example, by flight-indicating tracking systems and/or sensors, the system proceeds to step 605. If not, however, the system proceeds to step 625, and various pre-launch system steps, which will be discussed in more detail below.

In step 605, the system may determine whether the missile is currently located at a minimum safe distance for warhead armament and mode initiation, which minimum safe distance may be variably set based on the type of missile, missile altitude, speed, other environmental factors, the warhead, and possible warhead modes, and based upon other user and/or system settings, which may be variable. The minimum safe distance may be measured from the launch site and/or other areas to be protected from accidental weapon detonation. If the missile has not reached at least a minimum safe distance with respect to at least one such protected area, the system may implement or retain safety controls in the missile to maintain disarmament of the warhead and prevent the initiation of other warhead modes, and the system returns to the starting position.

If the missile has reached at least a minimum safe distance with respect to each such protected area, however, the system proceeds to step 607, in which it determines whether Command and Control has issued post-launch orders relevant to the missile's deployment. If not, the system next determines whether previously-stored orders (for example, from commands given prior to missile flight) have been recorded and, if so, implements them in step 608, and, in any event, the system then returns to the starting position. If the system instead determines at step 607 that post-launch orders have been issued, the system instead proceeds to step 609, in which it determines whether such current, post-launch orders modify or otherwise conflict with any prior stored orders. If so, the system proceeds to step 611, in which it resolves any such conflict in favor of the more current orders by updating, modifying and/or removing the conflicting prior stored orders, such that they no longer conflict. If no such conflict is found, however, the system instead proceeds to step 613 and implements the prior orders. In either event, the system next proceeds to step 615, in which it determines whether, among the post-launch commands, Command and Control has ordered selection of a Warhead Mode. As mentioned above, a warhead according to aspects of the present invention may be user variable, and "dialed in" for particular tactical objectives, even post-launch and in mid-flight, for example, if the missile is ordered to loiter while Command and Control determines what action to take with respect to a target. For example, as discussed above, in one setting, the warhead may begin to be charged with a maximum concentration and compression of mid-flight loaded oxidizer, and charges may be optimally engaged and/or positioned by servo/motors, thereby implementing a maximum yield warhead. As another warhead setting alternative, near the other side of the yield spectrum, a low concentration of oxidizer or non-oxidizer may be loaded to maximize momentum for a kinetic deployment only, and no explosion. In addition, infinite settings between or about these extremes may be selected. Whatever the selected setting, the system implements such Warhead Mode settings in step 617, and then proceeds to steps 619 and 621, in which it implements or stores additional orders, as necessary, from Command and Control, if any. If, in step 615, no Warhead Mode settings have been entered by Command and Control, the system proceeds directly to steps 619 and 621, skipping step 617. In either case, after step 621, the system proceeds to step 623, in which it may receive important mission-relevant information from any source, such as from on-board tracking and sensors aboard the missile, or other sources, and relays representations of such information to Command and Control. After step 623, the system returns to the starting position.

Returning to the starting position, and first step 603, if the system determines that the missile is not yet in flight, Command and Control may nonetheless proceed to several useful pre-launch system steps, beginning with step 625. In step 625, the system determines whether Command and Control has issued any orders related to missile deployment. If not, the system returns to the starting position. If so, however, the system next proceeds to step 627, in which it may determine whether Command and Control has selected a Warhead Mode, such as those discussed above with respect to step 615. If so, the system stores that selection in step 629 as an order for implementation after launch (after minimum safe distance, and if not overridden by conflicting in-flight orders, as discussed above). After step 629, or directly after step 627 if no Warhead Mode selection was made, the system next proceeds to step 631, in which it determines whether Command and Control has issued any other relevant orders for the system and, if so, proceeds to implement or store such orders in step 633. In any event, before returning to the starting position, the system may again relay any mission critical information to command and control, in step 623.

I claim:

1. A system for loading a missile after launch, comprising a storage unit volume and a filtering and compressing device configured to load, concentrate and compress gas or other material from the atmosphere surrounding the missile in flight into said storage unit volume, wherein said storage unit volume is configured to store at least some of said gas or other material for deployment at a target.

2. The system for loading a missile after launch of claim 1, wherein said filtering and compressing device is configured to filter out, remove, and concentrate an ambient oxidizer, and to combine said oxidizer with a fuel in said storage unit volume or during deployment at said target.

3. The system for loading a missile after launch of claim 2, wherein said ambient oxidizer is oxygen within atmospheric air surrounding the missile mid-flight.

4. The system for loading a missile after launch of claim 1, comprising a subsystem configured to concentrate and compress said gas or other material, wherein said subsystem is further configured to release said gas or other material into the surrounding atmosphere prior to deployment of said missile at said target.

5. The system for loading a missile after launch of claim 4, further comprising a control subsystem configured to control said release of said gas or other material into the surrounding atmosphere prior to deployment of said missile at said target, to yield substantial changes in lift, yaw, pitch, roll or other flight dynamics of said missile.

6. The system for loading a missile after launch of claim 1, further comprising a remote control subsystem configured to modify the concentration, compression, combination or relative location of said gas or other material for deployment at a target, to correspond with at least one target-related selection or setting.

7. The system for loading a missile after launch of claim 6, wherein said at least one target-related selection or setting comprises a configuration in which an oxidizer or fuel is disabled and rendered substantially useless as an explosive, by unloading or scattering said oxidizer or fuel in flight, adding a deactivating ingredient, or combusting said oxidizer or fuel in flight at a minimum safe distance from any target or protected area.

8. A system for loading a missile after launch, comprising a storage unit volume and filtering and compressing device configured to load and compress gas or other material from the atmosphere surrounding the missile in flight into said storage unit volume, at least in part, by converting or storing power from airflow about and through the moving missile, and wherein said storage unit volume and filtering and compressing device is configured to store at least some of said gas or other material, or power for deployment at a target.

9. The system for loading a missile after launch of claim 8, wherein said filtering and compressing device is configured to filter out and concentrate an ambient oxidizer, and combine said oxidizer with a fuel in said storage unit volume or during deployment at said target.

10. The system for loading a missile after launch of claim 9, wherein said oxidizer is oxygen within atmospheric air surrounding the missile mid-flight.

11. The system for loading a missile after launch of claim 8, further comprising a subsystem configured to concentrate and compress said gas or other material, wherein said subsystem is further configured to release said gas or other material into the surrounding atmosphere prior to deployment at said target.

12. The system for loading a missile after launch of claim 11, further comprising a control subsystem configured to control said release of said gas or other material into the surrounding atmosphere prior to deployment at said target to yield substantial changes in lift, yaw, pitch, roll or other flight dynamics of said missile.

13. The system for loading a missile after launch of claim 8, further comprising a remote control subsystem configured to modify the concentration, compression, combination or relative location of said gas or other material for deployment at a target to correspond with a warhead mode or other target-specific selections or settings.

14. The system for loading a missile after launch of claim 13, wherein said warhead mode comprises a configuration in which an oxidizer or fuel is disabled and rendered substantially useless as an explosive if said missile is intercepted, by unloading or scattering said oxidizer or fuel in flight, adding a deactivating ingredient, or combusting said oxidizer or fuel in flight at a minimum safe distance from any target or protected area.

15. A system for variably loading a missile after launch comprising a storage unit volume and a filtering and compressing device configured to load, concentrate, and compress gas or other material from atmosphere surrounding the missile in flight into said storage unit volume, at least in part, by releasing or using stored potential or translated energy and wherein said filtering and compressing device is further configured to compress said gas or other material, and store at least some of said gas or other material, or energy in said storage unit volume for deployment at a target.

16. The system for loading a missile after launch of claim 15, wherein said filtering and compressing device is configured to filter out, remove, and concentrate an ambient oxidizer including oxygen within atmospheric air surrounding the missile, wherein said filtering and compressing device combines said oxidizer with a fuel in said storage unit volume.

17. The system for loading a missile after launch of claim 15, further comprising a subsystem configured to further concentrate and compress said gas or other material, and wherein said subsystem is further configured to release said gas or other material into the surrounding atmosphere prior to deployment at said target.

18. The system for loading a missile after launch of claim 17, further comprising a control subsystem configured to control said release of said gas or other material into the surrounding atmosphere prior to deployment at said target to yield substantial changes in lift, yaw, pitch, roll or other flight dynamics of said missile.

19. The system for loading a missile after launch of claim 15, further comprising a remote control subsystem configured to modify the concentration, compression, combination or relative location of said gas or other material for deployment at a target to correspond with a warhead mode or other target-related selections or settings.

20. The system for loading a missile after launch of claim 19, wherein said warhead mode comprises a configuration in which an oxidizer or fuel is disabled and rendered substantially useless as an explosive if said missile is intercepted, by unloading or scattering said oxidizer or fuel in flight, adding a deactivating ingredient, or combusting said oxidizer or fuel in flight at a minimum safe distance from any target or a protected area.

* * * * *